US005369913A

United States Patent [19]

Brickner

[11] Patent Number: 5,369,913

[45] Date of Patent: Dec. 6, 1994

[54] CLOSURE LOCK

[76] Inventor: Joseph L. Brickner, 3046 Skywood St., Orange, Calif. 92665

[21] Appl. No.: 166,046

[22] Filed: Dec. 14, 1993

Related U.S. Application Data

[63] Continuation-in-part of Ser. No. 48,296, Apr. 19, 1993, abandoned.

[51] Int. Cl.[5] ..... E05F 11/00

[52] U.S. Cl. ..... 49/360; 318/760

[58] Field of Search ..... 49/139, 360; 318/87, 318/379, 760

[56] References Cited

U.S. PATENT DOCUMENTS

| | | | |
|---|---|---|---|
| 4,313,281 | 2/1982 | Richmond | 49/139 X |
| 4,812,728 | 3/1989 | Yang | 318/760 |
| 4,945,677 | 8/1990 | Kramer | 49/139 X |
| 4,954,759 | 9/1990 | Fey | 318/760 X |
| 5,076,012 | 12/1991 | Richmond et al. | 49/139 X |

*Primary Examiner*—Peter M. Cuomo
*Assistant Examiner*—Jerry Redman

[57] ABSTRACT

A closure lock which utilizes the operating motor for moving of the closure as the locking mechanism. A shorting circuit is applied across the motor when the closure is in an at-rest position. Any attempt at manually moving of the closure between the closed position of the closure and the open position of the closure will require the rotor of the motor to be rotated relative to the stator of the motor. This requires a significant amount of motor drag to be overcome which is difficult and thereby functions as a locking mechanism preventing operating of the closure. This closure lock can be bypassed by an authorized person by the opening of a manually operated switch which will permit the closure to be easily moved between its open and closed position.

2 Claims, 1 Drawing Sheet

CLOSURE LOCK

REFERENCE TO PRIOR APPLICATION

This application is a continuation-in-part of patent application Ser. No. 08/048,296, filed Apr. 19, 1993, by the title of GATE LOCK and by the same inventor.

BACKGROUND OF THE INVENTION

1. Field of the Invention

The field of this invention relates to locking devices and more particularly to a closure locking device which is intended to prevent movement of a gate or door from a closed position to the open position except by an authorized person or persons.

2. Description of the Prior Art

The subject matter of this invention will be discussed in conjunction with gates with it being understood that it is applicable to other types of closures such as doors. Electrically operated gates have long been known. These gates are commonly used in conjunction with fences or walls and are intended to prevent access of unauthorized individuals through the wall or fence.

When the gate is in its closed position, it is desirable to lock the gate so as to make it impossible or exceedingly difficult for a human to manually open the gate in order to gain entry. It has been common in the past to employ various types of electromechanical locking devices to achieve this gate locking feature. These electromechanical devices are reasonably complicated, expensive and do at times fail which require maintenance and/or replacement.

SUMMARY OF THE INVENTION

The primary objective of the present invention is to construct a closure lock in conjunction with the normal electrical operating motor of the closure which eliminates the need for any additional electromechanical closure locking device.

Another objective of the present invention is to construct a closure lock which can be incorporated in conjunction with a closure inexpensively and which is simple thereby minimizing the failure of any part of the closure lock over an extended period of years of usage.

A primary mode of usage of the structure of the present invention is in conjunction with a gate which is normally usable within an outdoors environment to close either a roadway or pathway and is mounted in conjunction with a fence or wall. The gate can be moved either by pivoting or can be moved lineally. An electrically operated motor is to be used through a driving gear arrangement to move the gate between its open and closed position. The movement of the gate is accomplished by an electrically driven DC motor which is operated from a power source. A shorting circuit places a direct short across the motor when the motor is not operating, that is when the gate is in its closed or its open position. If there is any manual movement of the gate from the closed position toward the open position, this manual movement will be resisted by the motor and this resistance is sufficiently substantial to generally discourage unauthorized opening of the gate. If for any reason manual movement of the gate is desired by an authorized individual, there is provided a manually operated switch which will open the shorting circuit thereby eliminating the magnetic field of the rotor of the motor which permits the rotor to turn easily relative to the stator thereby permitting the gate to be easily moved between the open and closed position.

DETAILED DESCRIPTION OF THE SHOWN EMBODIMENT

Figure 1:
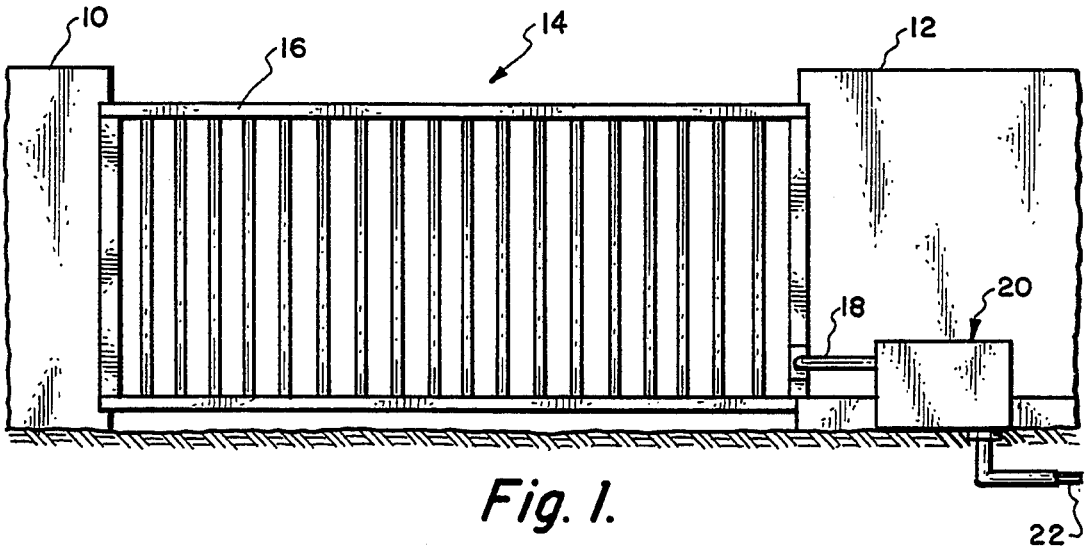
FIG. 1 is an isometric view of a typical gate and the gate operating mechanism within which the closure lock of the present invention is incorporated.

Referring particularly to the drawing there is shown walls 10 and 12 which are located in an aligned position with a space 14 being located therebetween. Located within the area of the space 14 is a closure shown as a gate 16. Normally the gate 16 will be constructed of a metallic material such as wrought iron. The gate 16 is connected by an operating arm 18 to a closure operating mechanism 20. The closure operating mechanism 20 is to receive electrical power through conductor 22 from a power source (not shown). A typical power source would be a direct current (DC) battery.

The closure operating mechanism 20 includes, in part, a direct current motor 24. The motor 24 must include a permanent magnet stator 25 and a rotor 27. The motor 24 is to be reversible so that it can be rotated in one direction which will result in the gate 16 being moved from its closed position to an open position permitting access through the space 14, or the motor 24 can be turned in the opposite direction which will result in the gate 16 being moved from its open position to its closed position. The closed position is shown in FIG. 1. The open position would be with the gate 16 located in juxtaposition with wall 12 where the gate 16 slides lineally to the open position. The motor 24 can be of any various sizes with the size of the motor 24 being selected on the basis of the size and weight of the gate 16.

A commutator connects with the rotor 27 in the form of a pair of terminals comprising brushes 23 and 29. Lead 26 connects with brush 23. Lead 28 connects with brush 29. The commutator could comprise other types of terminals such as transistor switches. Other brushless devices could be used.

Lead 26 connects to a relay switch 30 with lead 28 connecting to a relay switch 32. Relay switch 30 is movable between electrical contacts 34 and 36. Relay switch 32 is movable between electrical contacts 38 and 40. The normal at-rest position of relay switch 30 is in electrical connection with contact 34. The normal at-rest position of the relay switch 32 is in electrical connection with the contact 38. This would be the position that switches 30 and 32 would occupy when the gate 16 is non-moving or in an at-rest position such as when it is in the closed position or its open position.

Associated with relay switch 30 is a relay coil 42. Associated with relay switch 32 is relay coil 44. Relay coils 42 and 44 are connected to appropriate control operating circuitry 46 that is deemed to be conventional. Input commands are to be supplied through appropriate input command activation devices 48 which will cause operation of the control circuitry 46 to activate either coil 42 or coil 44. Coils 42 and 44 are never operated simultaneously. Operation of coil 42 will cause the switch 30 to disengage from contact 34 and engage with contact 36. This will cause power from the power supply 50 to be supplied through conductors 52 and 54 into lead 26 of the DC motor 24. Lead 28 from the DC motor 24 is connected through conductor 56 back to the power supply 50 thereby completing the circuit. As a result, the motor 24 will be operated in the direction to open the gate 16.

When the gate 16 is completely open, electrical power is no longer being supplied to the coil 42 and the switch 30 will disengage from contact 36 and reengage with contact 34. When the appropriate input command from input command activation device 48 is supplied to the control circuitry 46 to move the gate 16 to the closed position, coil 44 is then activated. This causes the switch 32 to disengage from contact 38 and engage with contact 40. This causes power from the power supply 50 to be transmitted through conductor 52, through conductor 58 and into lead 28 and into the motor 24. From the motor 24 the circuit is completed by lead 26 being connected to conductor 60 which connects to conductor 56 and into the power supply 50. When the gate 16 is completely closed, the coil 44 is deactivated and the switch 32 again moves from contact 40 to reconnect with contact 38.

Figure 2:
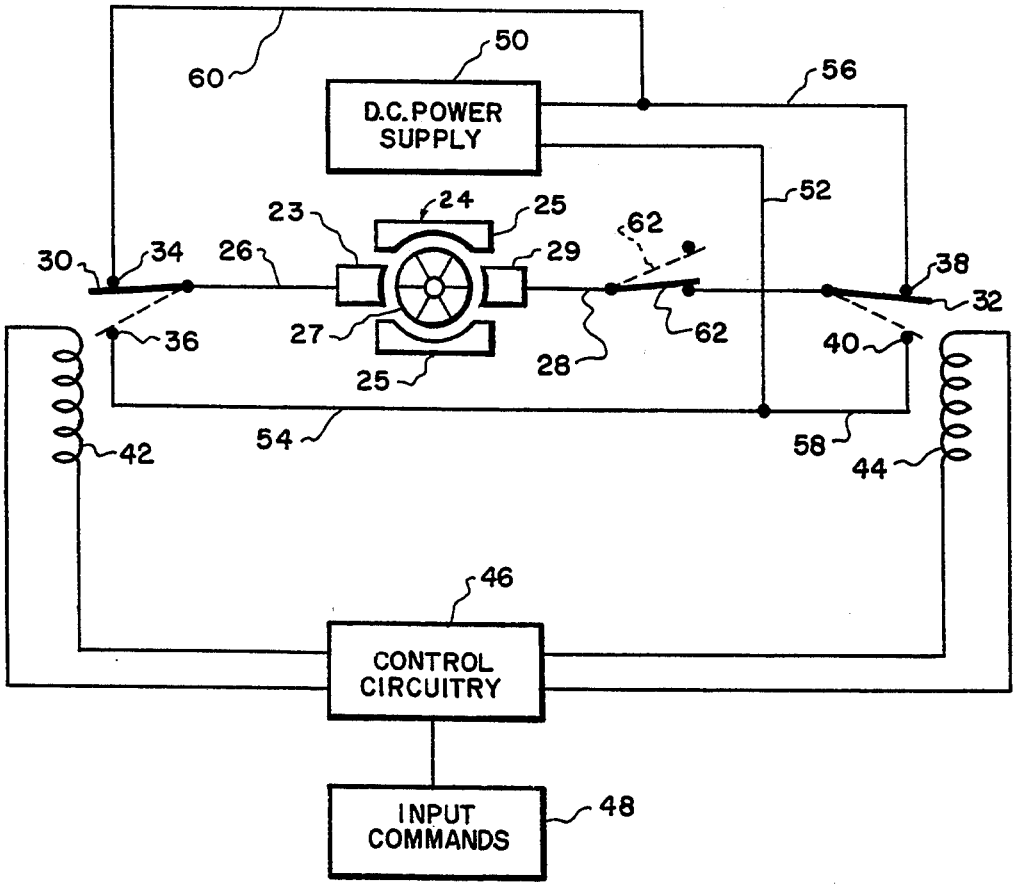
FIG. 2 is an electrical schematic of the circuit utilized in conjunction with the electrical motor utilized to move the gate between its open and closed position.

In referring particularly to FIG. 2 of the drawing, its can be seen that when the gate 16 is closed or even when the gate 16 is open, switch 30 connects with contact 34 and switch 32 connects with contact 38. This causes an electrical short across the motor 24. A magnetic field is produced in rotor 27. This magnetic field reacts in conjunction with the permanent magnetic field of permanent magnets 25. This reaction is similar to the attraction of the north pole of one magnet being attracted to the south pole of another magnet. This attraction force makes it most difficult to manually turn rotor 27 relative to the stator composed of magnets 25, thus a brake or lock is produced. Although it is not impossible to move the gate 16 in this situation, it is certainly difficult to do so and therefore the shorting circuit previously described functions as a locking device for the gate 16.

At times, it is desirable for an authorized individual to manually move the gate 16. If such manual movement is desired, switch 62, mounted within the lead 29, is to be moved to the open position shown in dotted lines in FIG. 2. The result is the shorting circuit is thereby disengaged and upon manual movement of the gate 16 being attempted, low frictional rotation of the rotor 27 relative to the stator 25 of the motor 24 is caused and the gate 16 could be easily opened (or closed). The magnetic field of the rotor 27 is no longer being generated as a result of switch 62 being open, hence no attracting force. When it is desired to thereby reengage the gate lock of this invention, the user only needs to move the switch 62 to the closed position.

What is claimed is:

1. In combination with a closure, said closure being movable by closure operating mechanism connected to said closure, said closure operating mechanism including an electrical motor, operation of said motor causes said closure to move between said open position and said closed position, control circuitry connected to said motor, upon input of manual commands said control circuitry to operate said motor to move said closure to be locatable in either said open position or said closed position, said closure to be stopped when either in said open position or said closed position assuming an at-rest position in either said open position or said closed position, the improvement comprising a closure lock associated with said motor, said closure lock comprising:

said motor comprising a direct current motor having a rotor and a permanent magnet stator, commutator means connecting with said rotor, said commutator means having a plurality of terminals, a shorting circuit connected between said plurality of terminals, during periods of non-operation of said motor and hence non-movement of said closure said shorting circuit establishing an attraction force between said stator and said rotor, during periods of operation of said motor said shorting circuit being bypassed not establishing said attraction force, said non-operation of said motor being when no electrical power is being applied to said motor, said attraction force resisting movement of said rotor when said closure is in a said at-rest position thereby making it difficult to manually move said rotor and hence said closure producing a closure locking mechanism when electrical power is not supplied to said motor.

2. The combination as defined in claim 1 wherein:

a manually operated switch included within said shorting circuit, said manually operated switch being movable between an open and a closed position, with said manually operated switch in said closed position said shorting circuit being established between said plurality of terminals which produces said closure locking mechanism which makes it difficult to manually move said closure between said open position and said closed position, with said manually operated switch being open said closure to be easily movable between said open position and said closed position.

* * * * *